US011088470B2

(12) United States Patent
Kwon et al.

(10) Patent No.: US 11,088,470 B2
(45) Date of Patent: Aug. 10, 2021

(54) ANTENNA DEVICE AND MOBILE TERMINAL HAVING THE SAME

(71) Applicant: LG ELECTRONICS INC., Seoul (KR)

(72) Inventors: Youngbae Kwon, Seoul (KR); Byungeun Jeon, Seoul (KR); Byungwoon Jung, Seoul (KR); Sungjoon Hong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 129 days.

(21) Appl. No.: 16/218,088

(22) Filed: Dec. 12, 2018

(65) Prior Publication Data

US 2019/0181564 A1 Jun. 13, 2019

(30) Foreign Application Priority Data

Dec. 12, 2017 (WO) ..... PCT/KR2017/014557

(51) Int. Cl.
*H01Q 1/24* (2006.01)
*H01Q 21/28* (2006.01)
(Continued)

(52) U.S. Cl.
CPC ..... *H01Q 21/28* (2013.01); *H01Q 1/16* (2013.01); *H01Q 1/243* (2013.01); *H01Q 5/35* (2015.01);
(Continued)

(58) Field of Classification Search
CPC ..... H01Q 1/243; H01Q 1/24; H01Q 21/28; H01Q 1/16; H01Q 5/35; H01Q 5/37;
(Continued)

(56) References Cited

U.S. PATENT DOCUMENTS 9,024,822 B2 5/2015 Tang
9,331,397 B2 * 5/2016 Jin ..... H01Q 9/06
(Continued)

FOREIGN PATENT DOCUMENTS

CN 101060204 10/2007
CN 102811501 12/2012
(Continued)

OTHER PUBLICATIONS

State Intellectual Property Office of the People's Republic of China Application Serial No. 201780097604.4, Office Action dated Nov. 2, 2020, 8 pages.
(Continued)

*Primary Examiner* — Tho G Phan
(74) *Attorney, Agent, or Firm* — Lee, Hong, Degerman, Kang & Waimey PC

(57) ABSTRACT

A mobile terminal according to the present invention includes a first conductive member forming a part of a lower end of an outer metal frame, and a second conductive member spaced apart from the first conductive member to form parts of the lower end and a side surface of the outer metal frame. The terminal may further include a conductive line connected to one point of each of the first conductive member and the second conductive member and interconnected inside the mobile terminal. At this time, an antenna device, in which the second conductive member is connected adjacent to a ground at a predetermined position from the one point of the second conductive member, so as to fully cover a low frequency band including an LTE, and which has a hand-effect compensation function, and a mobile terminal can be provided.

20 Claims, 11 Drawing Sheets

(51) Int. Cl.

| | |
|---|---|
| ***H01Q 1/16*** | (2006.01) |
| ***H01Q 9/42*** | (2006.01) |
| ***H01Q 5/371*** | (2015.01) |
| ***H01Q 5/35*** | (2015.01) |
| ***H01Q 5/378*** | (2015.01) |

(52) U.S. Cl.
CPC ..... *H01Q 5/371* (2015.01); *H01Q 5/378* (2015.01); *H01Q 9/42* (2013.01)

(58) Field of Classification Search
CPC ..... H01Q 5/371; H01Q 5/378; H01Q 9/42; H04M 1/02; H04M 1/0249
See application file for complete search history.

(56) References Cited

U.S. PATENT DOCUMENTS

| | | | | |
|---|---|---|---|---|
| 9,431,693 | B2 * | 8/2016 | Kwak | H01Q 1/243 |
| 9,722,300 | B2 * | 8/2017 | Choi | H01Q 1/521 |
| 9,893,755 | B2 * | 2/2018 | Mow | H01Q 1/243 |
| 10,476,167 | B2 * | 11/2019 | Ayala Vazquez | H01Q 5/35 |

FOREIGN PATENT DOCUMENTS

| | | |
|---|---|---|
| CN | 102394372 | 1/2015 |
| CN | 106207446 | 12/2016 |
| CN | 106450662 | 2/2017 |
| EP | 3229314 | 10/2017 |
| JP | 2007288649 | 11/2007 |
| JP | 2014146851 | 8/2014 |
| KR | 1020160056501 | 5/2016 |
| KR | 1020160146138 | 12/2016 |
| KR | 1020170020013 | 2/2017 |
| WO | 2018026136 | 2/2018 |
| WO | 2019068331 | 4/2019 |

OTHER PUBLICATIONS

European Patent Office Application Serial No. 17934911.3, Search Report dated Jun. 29, 2021, 9 pages.

* cited by examiner

ANTENNA DEVICE AND MOBILE TERMINAL HAVING THE SAME

CROSS-REFERENCE TO RELATED APPLICATIONS

Pursuant to 35 U.S.C. § 119, this application claims the benefit of earlier filing date and right of priority to International Application No. PCT/KR2017/014557, filed Dec. 12, 2017, the contents of which are hereby incorporated by reference herein in its entirety.

TECHNICAL FIELD

The present invention relates to a mobile terminal including an antenna device for transmitting and receiving a radio signal. More particularly, the present invention relates to a mobile terminal having a wideband antenna.

BACKGROUND ART

Terminals may be divided into mobile/portable terminals and stationary terminals according to mobility. Also, the mobile terminals may be classified into handheld types and vehicle mount types according to whether or not a user can directly carry.

Mobile terminals have become increasingly more functional. Examples of such functions include data and voice communications, capturing images and video via a camera, recording audio, playing music files via a speaker system, and displaying images and video on a display unit. Some mobile terminals include additional functionality which supports electronic game playing, while other terminals are configured as multimedia players. Specifically, in recent time, mobile terminals can receive broadcast and multicast signals to allow viewing of video or television programs As it becomes multifunctional, a mobile terminal can be allowed to capture still images or moving images, play music or video files, play games, receive broadcast and the like, so as to be implemented as an integrated multimedia player.

Efforts are ongoing to support and increase the functionality of mobile terminals. Such efforts include software and hardware improvements, as well as changes and improvements in the structural components.

In addition to those attempts, the mobile terminals are providing various services in recent years by virtue of commercialization of wireless communication systems using an LTE communication technology. Mobile communication services developed in order to provide various services according to user's needs use different mobile communication frequency bands which are currently used per each country and each communication company, and thus a design of an antenna satisfying characteristics in each frequency is needed.

Therefore, when a wideband antenna that satisfies multiple frequency bands with a single structure is designed, versatility of device manufacturers can be improved. Accordingly, the terminal antenna must provide multi-band services including not only LTE but also second- and third-generation mobile communication bands, and research and development thereof are required. However, it is very difficult to design an antenna that satisfies all low-bands in a limited space of a mobile terminal because of low efficiency, narrow bandwidth and the like.

In order to overcome these problems, researches on tunable antennas have been conducted. In this regard, the tunable antenna is a single radiator operating in several frequency bands, which may result in reducing a size of the antenna, achieving a wide effective bandwidth due to a frequency control function, and obtaining similar radiation characteristics and antenna gains in all frequency bands. However, general tunable antennas currently being studied are merely using a frequency sweeping function in a manner of switching at least two frequency bands using a switch or in a manner of using a variable-cap, and have a disadvantage of an entirely narrow tunable range. Such a tunable antenna has a problem in that it cannot satisfy a sufficient resonance length of the antenna in a limited space.

In addition, in the case of carrier aggregation (CA) using both a low frequency band and another frequency band, both frequency bands must be used, and thereby a tunable or switch type antenna cannot be used.

DETAILED DESCRIPTION OF THE DISCLOSURE

The present invention is directed to solving the aforementioned problems and other drawbacks. Another aspect of the present invention is to provide a mobile terminal having an antenna device with improved performance.

Still another aspect of the present invention is to provide an antenna device capable of implementing a wider frequency band.

According to one aspect of the present invention to achieve the objects and other advantages, there is provided a mobile terminal including, a first conductive member forming a part of a lower end of an outer metal frame, and a second conductive member spaced apart from the first conductive member and forming parts of the lower end and side surfaces of the outer metal frame. The mobile terminal may further include a conductive line connected to one point of each of the first conductive member and the second conductive member and interconnected inside the mobile terminal. At this time, an antenna device in which the second conductive member is connected adjacent to a ground at a predetermined point from the one point of the second conductive member, so as to fully cover a low frequency band including an LTE, and has a hand effect compensation function, and a mobile terminal can be provided.

According to one embodiment, the first conductive member may operate as a first antenna at a low frequency band (LB) by a length of the conductive line. In addition, the second conductive member may operate as a second antenna in a first frequency band different from the low frequency band.

According to one embodiment, the terminal may further include a third conductive member spaced apart from the first conductive member to form parts of the lower end and a second side surface of the outer metal frame. At this point, the third conductive member may be connected to the ground at one point of the second side surface, and the third conductive member may operate as a third antenna in a second frequency band.

According to one embodiment, the first and second conductive members may be formed on the metal frame of the mobile terminal. The conductive line may be formed as a conductive pattern printed on one surface of a carrier disposed in a space between the metal frame and a battery cover.

According to one embodiment, the conductive line may be provided with a first conductive line connected to one point of the first conductive member and a second conductive line connected to one point of the second conductive member. At this time, the first and second conductive lines may be connected to an input of a single pole double through (SPDT) switch.

According to one embodiment, the terminal may further include a third conductive member spaced apart from the first conductive member to form parts of the lower end and a second side surface of the outer metal frame. At this time, the first conductive member may be connected to an input of a single pole four through (SP4T) switch at a predetermined position from a slit spaced apart from the third conductive member.

According to one embodiment, the terminal may further include a third conductive member spaced apart from the first conductive member to form parts of the lower end and a second side surface of the outer metal frame. At this time, the second conductive member may be spaced apart from the first conductive member by a first slit, and the third conductive member may be spaced apart from the second conductive member by a second slit.

According to one embodiment, the conductive line may be provided with a first conductive line connected to one point of the first conductive member and a second conductive line connected to a first point of the second conductive member. At this time, the second conductive line may be connected to the second conductive member via the first point adjacent to the first slit.

According to one embodiment, the second conductive line may be connected to the second conductive member via the second point adjacent to the second slit.

According to one embodiment, the second conductive member and an input of an SP4T switch may be connected to each other at a third point on the second conductive member. The first point may be formed on the second conductive member between the first slit and the third point.

According to one embodiment, the terminal may further include a first feeding part connected to the first conductive line at a second point located between a ground on the first conductive member and a connected point of the first and second conductive lines. The first feeding part may feed a first antenna operating in a low frequency band (LB) by a length of the first conductive member and the conductive line.

According to one embodiment, the terminal may further include a stub part electrically connected on the first conductive member, and configured to tune a resonance characteristic of the first antenna so that the first antenna operates in the low frequency band (LB).

According to one embodiment, the terminal may further include a second feeding part connected to the second conductive member on one end portion of the first conductive member. The second feeding part may be electrically connected on the second conductive member and feed a second antenna operating in a first frequency band by a length of the second conductive member.

According to one embodiment, the terminal may further include a third feeding part connected to the third conductive member on one end portion of the third conductive member. The third feeding part may be electrically connected on the third conductive member and feed the third antenna operating in a second frequency band by a length of the third conductive member.

According to one embodiment, the terminal may further include a controller to control receiving a first signal of the low frequency band through the first antenna and simultaneously receiving a second signal of the first frequency band. At this time, the controller may control only the first signal to be received through the first antenna when a signal-to-interference ratio (SIR) of the second signal is a threshold value or less.

According to one embodiment, the controller may control only the first signal to be received through the first antenna when it is determined that the second antenna is gripped by a user.

Effect of the Disclosure

Hereinafter, effects of a mobile terminal and an antenna device according to the present invention will be described.

According to at least one of embodiments of the present invention, an antenna device which is capable of fully covering a low frequency band including an LTE and has a hand-effect compensation function, and a mobile terminal can be provided.

In addition, according to at least one of embodiments of the present invention, deterioration of antenna characteristics due to a contact with a user's body can automatically be recognized, thereby improving the deterioration of the antenna characteristics.

Furthermore, according to at least one of embodiments of the present invention, an antenna device that operates even in a situation simultaneously using a plurality of frequency bands can be provided.

Further scope of applicability of the present invention will become apparent from the following detailed description. It should be understood, however, that the detailed description and specific examples, such as the preferred embodiment of the invention, are given by way of illustration only, since various changes and modifications within the spirit and scope of the invention will be apparent to those skilled in the art.

BEST MODE OF THE DISCLOSURE

Figure 1A:
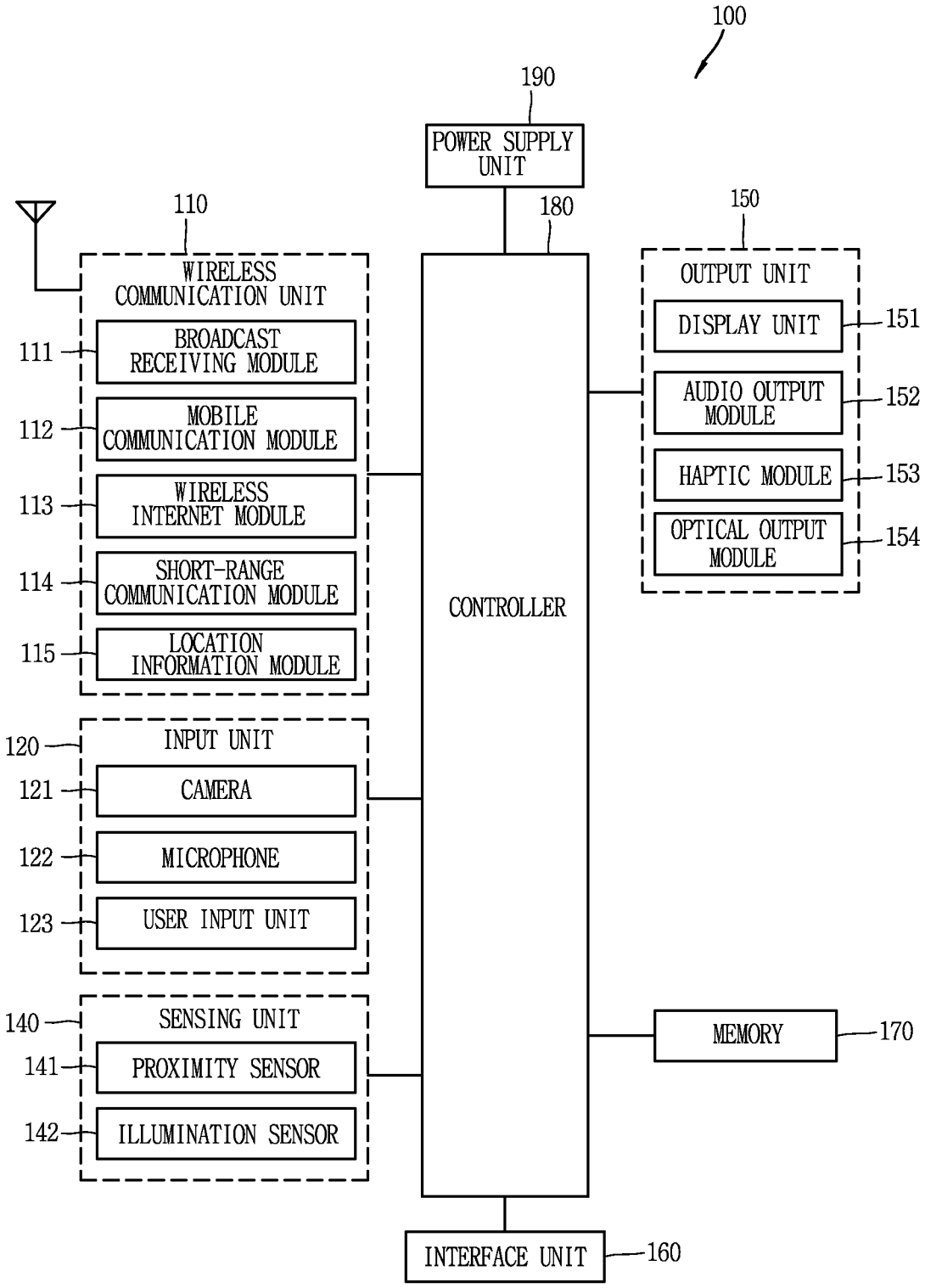
FIG. 1A is a block diagram of a mobile terminal in accordance with one exemplary embodiment of the present invention.

Description will now be given in detail according to exemplary embodiments disclosed herein, with reference to the accompanying drawings. For the sake of brief description with reference to the drawings, the same or equivalent components may be provided with the same or similar reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In describing the present disclosure, if a detailed explanation for a related known function or construction is considered to unnecessarily divert the gist of the present disclosure, such explanation has been omitted but would be understood by those skilled in the art. The accompanying drawings are used to help easily understand the technical idea of the present disclosure and it should be understood that the idea of the present disclosure is not limited by the accompanying drawings. The idea of the present disclosure should be construed to extend to any alterations, equivalents and substitutes besides the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be connected with the another element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

Mobile terminals presented herein may be implemented using a variety of different types of terminals. Examples of such terminals include cellular phones, smart phones, user equipment, laptop computers, digital broadcast terminals, personal digital assistants (PDAs), portable multimedia players (PMPs), navigators, portable computers (PCs), slate PCs, tablet PCs, ultra books, wearable devices (for example, smart watches, smart glasses, head mounted displays (HMDs)), and the like.

By way of non-limiting example only, further description will be made with reference to particular types of mobile terminals. However, such teachings apply equally to other types of terminals, such as those types noted above. In addition, these teachings may also be applied to stationary terminals such as digital TV, desktop computers, and the like.

Figure 1B:
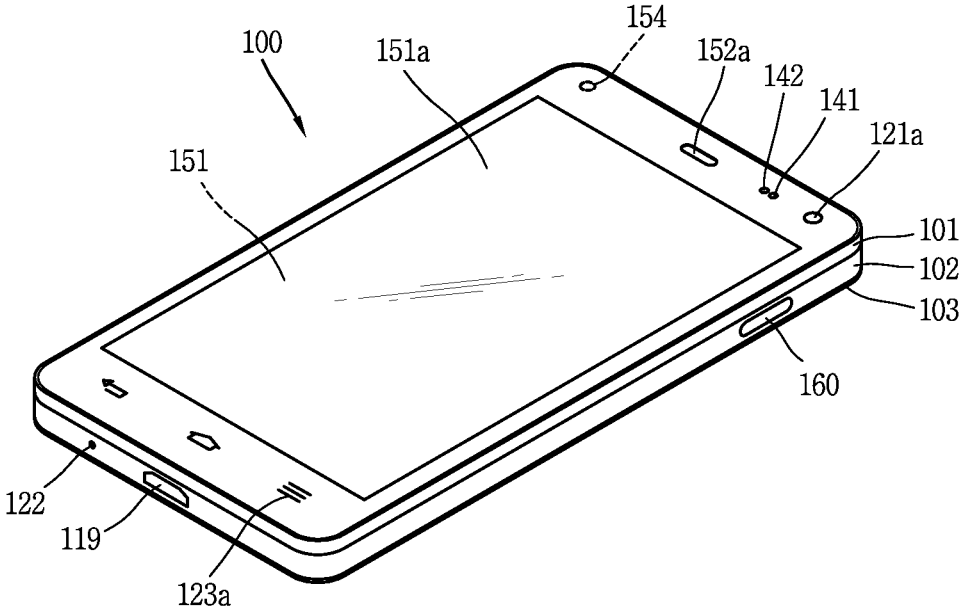
FIGS. 1B and 1C are conceptual views illustrating one example of a mobile terminal according to the present invention, viewed from different directions.
Figure 1C:
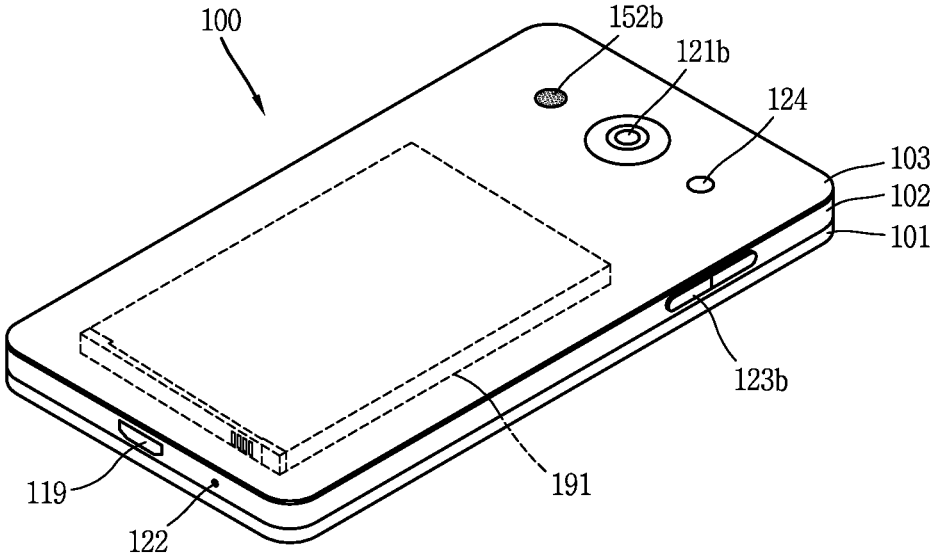

Referring to FIGS. 1A to 1C, FIG. 1A is a block diagram of a mobile terminal in accordance with one exemplary embodiment of the present invention, and FIGS. 1B and 1C are conceptual views illustrating one example of a mobile terminal, viewed from different directions.

The mobile terminal 100 may be shown having components such as a wireless communication unit 110, an input unit 120, a sensing unit 140, an output unit 150, an interface unit 160, a memory 170, a controller 180, and a power supply unit 190. It is understood that implementing all of the illustrated components is not a requirement, and that greater or fewer components may alternatively be implemented.

In more detail, the wireless communication unit 110 may typically include one or more modules which permit communications such as wireless communications between the mobile terminal 100 and a wireless communication system, communications between the mobile terminal 100 and another mobile terminal, or communications between the mobile terminal 100 and an external server. Further, the wireless communication unit 110 may typically include one or more modules which connect the mobile terminal 100 to one or more networks.

The wireless communication unit 110 may include one or more of a broadcast receiving module 111, a mobile communication module 112, a wireless Internet module 113, a short-range communication module 114, and a location information module 115.

The input unit 120 may include a camera 121 or an image input unit for obtaining images or video, a microphone 122, which is one type of audio input device for inputting an audio signal, and a user input unit 123 (for example, a touch key, a mechanical key, and the like) for allowing a user to input information. Data (for example, audio, video, image, and the like) may be obtained by the input unit 120 and may be analyzed and processed according to user commands.

The sensing unit 140 may typically be implemented using one or more sensors configured to sense internal information of the mobile terminal, the surrounding environment of the mobile terminal, user information, and the like. For example, the sensing unit 140 may include at least one of a proximity sensor 141, an illumination sensor 142, a touch sensor, an acceleration sensor, a magnetic sensor, a G-sensor, a gyroscope sensor, a motion sensor, an RGB sensor, an infrared (IR) sensor, a finger scan sensor, a ultrasonic sensor, an optical sensor (for example, camera 121), a microphone 122, a battery gauge, an environment sensor (for example, a barometer, a hygrometer, a thermometer, a radiation detection sensor, a thermal sensor, and a gas sensor, among others), and a chemical sensor (for example, an electronic nose, a health care sensor, a biometric sensor, and the like). The mobile terminal disclosed herein may be configured to utilize information obtained from one or more sensors of the sensing unit 140, and combinations thereof.

The output unit 150 may typically be configured to output various types of information, such as audio, video, tactile output, and the like. The output unit 150 may be shown having at least one of a display unit 151, an audio output module 152, a haptic module 153, and an optical output module 154. The display unit 151 may have an inter-layered structure or an integrated structure with a touch sensor in order to implement a touch screen. The touch screen may function as the user input unit 123 which provides an input interface between the mobile terminal 100 and the user and simultaneously provide an output interface between the mobile terminal 100 and a user.

The interface unit 160 serves as an interface with various types of external devices that are coupled to the mobile terminal 100. The interface unit 160, for example, may include any of wired or wireless ports, external power supply ports, wired or wireless data ports, memory card ports, ports for connecting a device having an identification module, audio input/output (I/O) ports, video I/O ports, earphone ports, and the like. In some cases, the mobile terminal 100 may perform assorted control functions associated with a connected external device, in response to the external device being connected to the interface unit 160.

The memory 170 is typically implemented to store data to support various functions or features of the mobile terminal 100. For instance, the memory 170 may be configured to store application programs executed in the mobile terminal 100, data or instructions for operations of the mobile terminal 100, and the like. Some of these application programs may be downloaded from an external server via wireless communication. Other application programs may be installed within the mobile terminal 100 at time of manufacturing or shipping, which is typically the case for basic functions of the mobile terminal 100 (for example, receiving a call, placing a call, receiving a message, sending a message, and the like). Application programs may be stored in the memory 170, installed in the mobile terminal 100, and executed by the controller 180 to perform an operation (or function) for the mobile terminal 100.

The controller 180 typically functions to control an overall operation of the mobile terminal 100, in addition to the operations associated with the application programs. The controller 180 may provide or process information or functions appropriate for a user by processing signals, data, information and the like, which are input or output by the aforementioned various components, or activating application programs stored in the memory 170.

Also, the controller 180 may control at least some of the components illustrated in FIG. 1A, to execute an application program that have been stored in the memory 170. In addition, the controller 180 may control at least two of those components included in the mobile terminal 100 to activate the application program.

The power supply unit 190 may be configured to receive external power or provide internal power in order to supply appropriate power required for operating elements and components included in the mobile terminal 100. The power supply unit 190 may include a battery, and the battery may be configured to be embedded in the terminal body, or configured to be detachable from the terminal body.

At least part of the components may cooperatively operate to implement an operation, a control or a control method of a mobile terminal according to various embodiments disclosed herein. Also, the operation, the control or the control method of the mobile terminal may be implemented on the mobile terminal by an activation of at least one application program stored in the memory 170.

Referring to FIGS. 1B and 1C, the disclosed mobile terminal 100 includes a bar-like terminal body. However, the mobile terminal 100 may alternatively be implemented in any of a variety of different configurations. Examples of such configurations include watch type, clip-type, glasses-type, or a folder-type, flip-type, slide-type, swing-type, and swivel-type in which two and more bodies are combined with each other in a relatively movable manner, and combinations thereof. Discussion herein will often relate to a particular type of mobile terminal. However, such teachings with regard to a particular type of mobile terminal will generally apply to other types of mobile terminals as well.

Here, considering the mobile terminal 100 as at least one assembly, the terminal body may be understood as a conception referring to the assembly.

The mobile terminal 100 will generally include a case (for example, frame, housing, cover, and the like) forming the appearance of the terminal. In this embodiment, the case is formed using a front case 101 and a rear case 102. Various electronic components are interposed into a space formed between the front case 101 and the rear case 102. At least one middle case may be additionally positioned between the front case 101 and the rear case 102.

The display unit 151 is shown located on the front side of the terminal body to output information. As illustrated, a window 151*a* of the display unit 151 may be mounted to the front case 101 to form the front surface of the terminal body together with the front case 101.

In some embodiments, electronic components may also be mounted to the rear case 102. Examples of such electronic components include a detachable battery 191, an identification module, a memory card, and the like. In this case, a rear cover 103 is shown covering the electronic components, and this cover may be detachably coupled to the rear case 102. Therefore, when the rear cover 103 is detached from the rear case 102, the electronic components mounted on the rear case 102 are exposed to the outside.

As illustrated, when the rear cover 103 is coupled to the rear case 102, a side surface of the rear case 102 may partially be exposed. In some cases, upon the coupling, the rear case 102 may also be completely shielded by the rear cover 103. Meanwhile, the rear cover 103 may include an opening for externally exposing a camera 121*b* or an audio output module 152*b*.

The cases 101, 102, 103 may be formed by injection-molding synthetic resin or may be formed of a metal, for example, stainless steel (STS), aluminum (Al), titanium (Ti), or the like.

As an alternative to the example in which the plurality of cases forms an inner space for accommodating components, the mobile terminal 100 may be configured such that one case forms the inner space. In this case, a mobile terminal 100 having a uni-body is formed in such a manner that synthetic resin or metal extends from a side surface to a rear surface.

Meanwhile, the mobile terminal 100 may include a waterproofing unit (not shown) for preventing introduction of water into the terminal body. For example, the waterproofing unit may include a waterproofing member which is located between the window 151*a* and the front case 101, between the front case 101 and the rear case 102, or between the rear case 102 and the rear cover 103, to hermetically seal an inner space when those cases are coupled.

The mobile terminal 100 may include a display unit 151, first and second audio output module 152*a* and 152*b*, a proximity sensor 141, an illumination sensor 142, an optical output module 154, first and second cameras 121*a* and 121*b*, first and second manipulation units 123*a* and 123*b*, a microphone 122, an interface unit 160, and the like.

Hereinafter, as illustrated in FIGS. 1B and 1C, description will be given of the exemplary mobile terminal 100 in which the front surface of the terminal body is shown having the display unit 151, the first audio output module 152*a*, the proximity sensor 141, the illumination sensor 142, the optical output module 154, the first camera 121*a*, and the first manipulation unit 123*a*, the side surface of the terminal body is shown having the second manipulation unit 123*b*, the microphone 122, and the interface unit 160, and the rear surface of the terminal body is shown having the second audio output module 152*b* and the second camera 121*b*.

However, those components may not be limited to the arrangement. Some components may be omitted or rearranged or located on different surfaces. For example, the first manipulation unit 123*a* may not be located on the front surface of the terminal body, and the second audio output module 152*b* may be located on the side surface of the terminal body other than the rear surface of the terminal body.

The display unit 151 is generally configured to output information processed in the mobile terminal 100. For example, the display unit 151 may display execution screen information of an application program executing at the mobile terminal 100 or user interface (UI) and graphic user interface (GUI) information in response to the execution screen information.

The display module 151 may include at least one of a liquid crystal display (LCD), a thin film transistor-LCD (TFT LCD), an organic light-emitting diode (OLED), a flexible display, a three-dimensional (3D) display and an e-ink display.

The display unit 151 may be implemented using two display devices, according to the configuration type thereof. For instance, a plurality of the display units 151 may be arranged on one side, either spaced apart from each other, or these devices may be integrated, or these devices may be arranged on different surfaces.

The display unit 151 may include a touch sensor that senses a touch with respect to the display unit 151 so as to receive a control command in a touch manner. Accordingly, when a touch is applied to the display unit 151, the touch sensor may sense the touch, and a controller 180 may generate a control command corresponding to the touch. Contents input in the touch manner may be characters, numbers, instructions in various modes, or a menu item that can be specified.

On the other hand, the touch sensor may be configured in a form of a film having a touch pattern and disposed between a window 151*a* and a display (not illustrated) on a rear surface of the window, or may be a metal wire directly patterned on the rear surface of the window. Alternatively, the touch sensor may be formed integrally with the display. For example, the touch sensor may be disposed on a substrate of the display, or may be provided inside the display.

In this way, the display unit 151 may form a touch screen together with the touch sensor, and in this case, the touch screen may function as the user input unit (123, see FIG. 1A). In some cases, the touch screen may replace at least some of functions of a first manipulation unit 123*a*.

The first audio output module 152*a* may be implemented as a receiver for transmitting a call sound to a user's ear and the second audio output module 152*b* may be implemented as a loud speaker for outputting various alarm sounds or multimedia playback sounds.

The window 151*a* of the display unit 151 may include sound holes for emitting sounds generated from the first audio output module 152*a*. However, the present invention is not limited thereto, and the sounds may be released along an assembly gap between the structural bodies (for example, a gap between the window 151*a* and the front case 101). In this case, a hole independently formed to output audio sounds may not be seen or may otherwise be hidden in terms of appearance, thereby further simplifying the appearance of the mobile terminal 100.

The optical output module 154 may be configured to output light for indicating an event generation. Examples of such events may include a message reception, a call signal reception, a missed call, an alarm, a schedule alarm, an email reception, information reception through an application, and the like. When a user has checked a generated event, the controller 180 may control the optical output module 154 to stop the light output.

The first camera 121*a* may process image frames such as still or moving images obtained by the image sensor in a capture mode or a video call mode. The processed image frames can then be displayed on the display unit 151 or stored in the memory 170.

The first and second manipulation units 123*a* and 123*b* are examples of the user input unit 123, which may be manipulated by a user to provide input to the mobile terminal 100. The first and second manipulation units 123*a* and 123*b* may also be commonly referred to as a manipulating portion. The first and second manipulation units 123*a* and 123*b* may employ any method if it is a tactile manner allowing the user to perform manipulation with a tactile feeling such as touch, push, scroll or the like. The first and second manipulation units 123*a* and 123*b* may also be manipulated through a proximity touch, a hovering touch, and the like, without a user's tactile feeling.

The drawings are illustrated on the basis that the first manipulation unit 123*a* is a touch key, but the present invention may not be necessarily limited to this. For example, the first manipulation unit 123*a* may be configured as a mechanical key, or a combination of a touch key and a push key.

The content received by the first and second manipulation units 123*a* and 123*b* may be set in various ways. For example, the first manipulation unit 123*a* may be used by the user to input a command such as menu, home key, cancel, search, or the like, and the second manipulation unit 123*b* may be used by the user to input a command, such as controlling a volume level being output from the first or second audio output module 152*a* or 152*b*, switching into a touch recognition mode of the display unit 151, or the like.

On the other hand, as another example of the user input unit 123, a rear input unit (not shown) may be disposed on the rear surface of the terminal body. The rear input unit may be manipulated by a user to input a command for controlling an operation of the mobile terminal 100. The content input may be set in various ways. For example, the rear input unit may be used by the user to input a command, such as power on/off, start, end, scroll or the like, controlling a volume level being output from the first or second audio output module 152*a* or 152*b*, switching into a touch recognition mode of the display unit 151, or the like. The rear input unit may be implemented into a form allowing a touch input, a push input or a combination thereof.

The rear input unit may be disposed to overlap the display unit 151 of the front surface in a thickness direction of the terminal body. As one example, the rear input unit may be disposed on an upper end portion of the rear surface of the terminal body such that a user can easily manipulate it using a forefinger when the user grabs the terminal body with one hand. However, the present disclosure may not be limited to this, and the position of the rear input unit may be changeable.

When the rear input unit is disposed on the rear surface of the terminal body, a new user interface may be implemented using the rear input unit. Also, the aforementioned touch screen or the rear input unit may substitute for at least part of functions of the first manipulation unit 123*a* located on the front surface of the terminal body. Accordingly, when the first manipulation unit 123*a* is not disposed on the front surface of the terminal body, the display unit 151 may be implemented to have a larger screen.

On the other hand, the mobile terminal 100 may include a finger scan sensor which scans a user's fingerprint. The controller may use fingerprint information sensed by the finger scan sensor as an authentication means. The finger scan sensor may be installed in the display unit 151 or the user input unit 123.

The microphone 122 may be configured to receive the user's voice, other sounds, and the like. The microphone 122 may be provided at a plurality of places, and configured to receive stereo sounds.

The interface unit 160 may serve as a path allowing the mobile terminal 100 to interface with external devices. For example, the interface unit 160 may be at least one of a connection terminal for connecting to another device (for example, an earphone, an external speaker, or the like), a port for near field communication (for example, an Infrared DaAssociation (IrDA) port, a Bluetooth port, a wireless LAN port, and the like), or a power supply terminal for supplying power to the mobile terminal 100. The interface unit 160 may be implemented in the form of a socket for accommodating an external card, such as Subscriber Identification Module (SIM), User Identity Module (UIM), or a memory card for information storage.

The second camera 121*b* may be further mounted to the rear surface of the terminal body. The second camera 121*b* may have an image capturing direction, which is substantially opposite to the direction of the first camera unit 121*a*.

The second camera 121*b* may include a plurality of lenses arranged along at least one line. The plurality of lenses may be arranged in a matrix form. The cameras may be referred to as an 'array camera.' When the second camera 121*b* is implemented as the array camera, images may be captured in various manners using the plurality of lenses and images with better qualities may be obtained.

The flash 124 may be disposed adjacent to the second camera 121*b*. When an image of a subject is captured with the camera 121*b*, the flash 124 may illuminate the subject.

The second audio output module 152*b* may further be disposed on the terminal body. The second audio output module 152*b* may implement stereophonic sound functions in conjunction with the first audio output module 152*a*, and may be also used for implementing a speaker phone mode for call communication.

At least one antenna for wireless communication may be disposed on the terminal body. The antenna may be embedded in the terminal body or formed in the case. For example, an antenna which configures a part of the broadcast receiving module 111 (see FIG. 1A) may be retractable into the terminal body. Alternatively, an antenna may be formed in a form of film to be attached onto an inner surface of the rear cover 103 or a case including a conductive material may serve as an antenna.

The terminal body is provided with a power supply unit 190 (see FIG. 1A) for supplying power to the mobile terminal 100. The power supply unit 190 may include a batter 191 which is mounted in the terminal body or detachably coupled to an outside of the terminal body.

The battery 191 may receive power via a power cable connected to the interface unit 160. Also, the battery 191 may be (re)chargeable in a wireless manner using a wireless charger. The wireless charging may be implemented by magnetic induction or electromagnetic resonance.

On the other hand, the drawing illustrates that the rear cover 103 is coupled to the rear case 102 for shielding the battery 191, so as to prevent separation of the battery 191 and protect the battery 191 from an external impact or foreign materials. When the battery 191 is detachable from the terminal body, the rear case 103 may be detachably coupled to the rear case 102.

An accessory for protecting an appearance or assisting or extending the functions of the mobile terminal 100 may further be provided on the mobile terminal 100. As one example of the accessory, a cover or pouch for covering or accommodating at least one surface of the mobile terminal 100 may be provided. The cover or pouch may cooperate with the display unit 151 to extend the function of the mobile terminal 100. Another example of the accessory may be a touch pen for assisting or extending a touch input onto a touch screen.

Hereinafter, embodiments related to an antenna device having such configuration and a mobile terminal having the antenna device will be described with reference to the accompanying drawings. It will be apparent to those skilled in the art that the present invention may be embodied in other specific forms without departing from the spirit or essential characteristics thereof.

Figure 2:
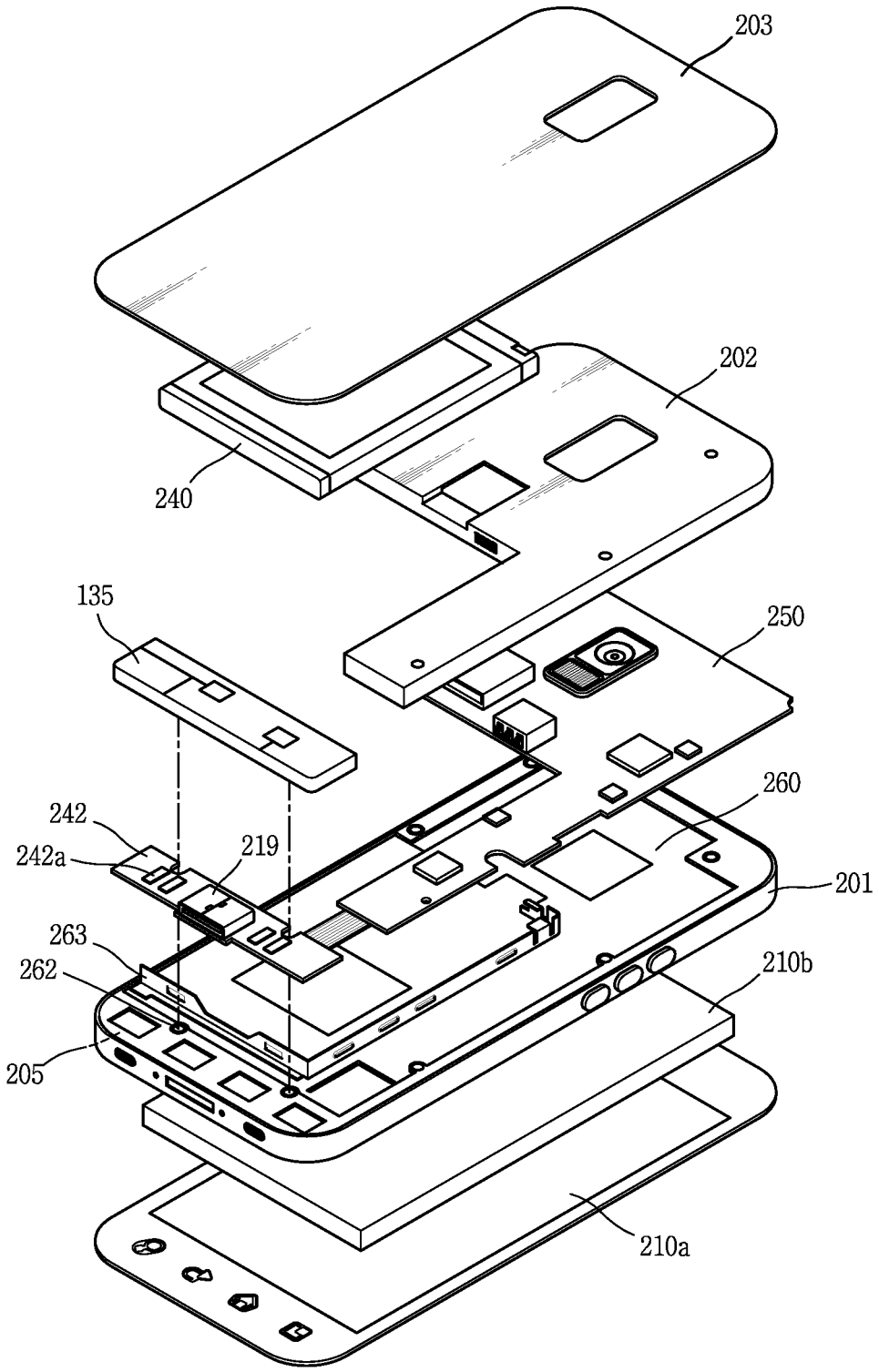
FIG. 2 is an exploded perspective view illustrating a mobile terminal in accordance with one embodiment of the present invention.

First, FIG. 2 is an exploded perspective view of a mobile terminal according to one embodiment of the present invention. Referring to FIG. 2, the mobile terminal includes a window 210*a* and a display module 210*b*, which constitute the display unit 210. The window 210*a* may be coupled to one surface of the front case 201. The window 210*a* and the display module 210*b* may be integrally formed with each other.

A frame 260 is formed between the front case 201 and the rear case 202 to support electric elements. In this regard, when the front case 201 and the rear case 202 are made of a metal, they may be referred to as a metal frame. However, an example in which the front case 201 is the metal frame 201 is disclosed for the sake of explanation, but the present invention is not limited to this. Alternatively, at least one of the front case 201 and the rear case 202 may be realized as a metal frame made of a metal material. On the other hand, at least part of a side surface of the metal frame 201 may operate as an antenna.

The frame 260 is a support structure inside the terminal. As one example, the frame 260 may support at least one of a display module 210*b*, a camera module 221, an antenna device, a battery 240 or a circuit board 250.

A part of the frame 260 may be exposed to the outside of the terminal. Also, the frame 260 may constitute a part of a sliding module that connects the main body and the display unit to each other in a slide type terminal, not a bar type.

FIG. 2 shows one example in which the circuit board 250 is disposed between the frame 260 and the rear case 202 and the display module 210*b* is coupled to one surface of the frame 260. The circuit board 250 and the battery may be disposed on another surface of the frame 260 and a battery cover 203 may be coupled to the rear case 202 to cover the battery.

The window 210*a* is coupled to one surface of the front case 201. A touch detecting pattern 210*c* for detecting a touch may be formed on one surface of the window 210*a*. The touch detecting pattern 210*c* is configured to detect a touch input, and is made to be light-transmissive. The touch detecting pattern 210*c* may be mounted on the front surface of the window 210*a* and may be configured to convert a change in voltage or the like generated in a specific portion of the window 210*a* into an electrical input signal.

The display module 210*b* is mounted on a rear surface of the window 210*a*. This embodiment exemplarily illustrates that the display module 210*b* is a thin film transistor-liquid crystal display (TFT LCD), but the present invention is not limited thereto.

For example, the display module 210*b* may be a liquid crystal display (LCD), an organic light-emitting diode (OLED), a flexible display, a three-dimensional display, and the like.

As described above, the circuit board 250 may be provided on one surface of the frame 260, but may alternatively be mounted on a lower portion of the display module 210*b*. At least one electronic element is mounted on a lower surface of the circuit board 250.

The frame 260 is provided with an accommodating portion formed in a recessed shape such that the battery 240 can be accommodated therein. A contact terminal connected to the circuit board 250 may be provided on one surface of the battery accommodating portion so that the battery 240 can supply power to the terminal body.

The frame 260 may be formed of a metal material to maintain sufficient rigidity even if the frame 260 is formed to have a small thickness. The metal frame 260 may operate as a ground. That is, the circuit board 250 or the antenna device may be grounded to the frame 260, and the frame 260 may operate as the ground of the circuit board 250 or the antenna device. In this case, the frame 260 may extend the ground of the mobile terminal.

The circuit board 250 is electrically connected to the antenna device and is configured to process radio signals (or radio electromagnetic waves) transmitted and received through the antenna device. For the processing of the radio signals, a plurality of transceiver circuits may be formed or mounted on the circuit board 250.

The transceiver circuits may include one or more integrated circuits and associated electrical components. In one example, the transceiver circuits may include a transmission integrated circuit, a reception integrated circuit, a switching circuit, an amplifier, and the like.

The plurality of transceiver circuits may simultaneously feed conductive members formed as conductive patterns that are radiators (emitters), so that a plurality of antenna devices can operate simultaneously. For example, while one antenna performs transmission, another one may perform reception, or both of them may perform transmission or reception.

A coaxial cable may be provided to connect the circuit board and each antenna device to each other. In one example, the coaxial cable may be connected to feeders that feed the antenna devices. The feeders may be provided on one surface of a flexible circuit board 242 which processes signals input from the manipulation unit 123*a*. Another surface of the flexible circuit board 242 may be coupled to a signal transfer unit which is configured to transmit a signal of the manipulation unit 123*a*. In this case, a dome may be formed on the another surface of the flexible circuit board 242, and an actuator may be provided on the signal transfer unit.

The flexible circuit board 242 is connected to a lower portion of a carrier 135. One end of the flexible circuit board 242 may be connected to the circuit board 250 which is provided with a controller. The flexible circuit board 242 may be connected to the manipulation unit 123*a* of the terminal. In this case, the flexible circuit board 242 is configured such that a signal generated by the manipulation unit 123*a* is transmitted to a controller of the circuit board 250.

Hereinafter, a mobile terminal in which at least part of a side surface of the metal frame 201 operates as an antenna in accordance with the present invention will be described. In this regard, FIG. 3 shows a wideband antenna using a metal frame and a metal pattern inside the mobile terminal according to the present invention.

Figure 3:
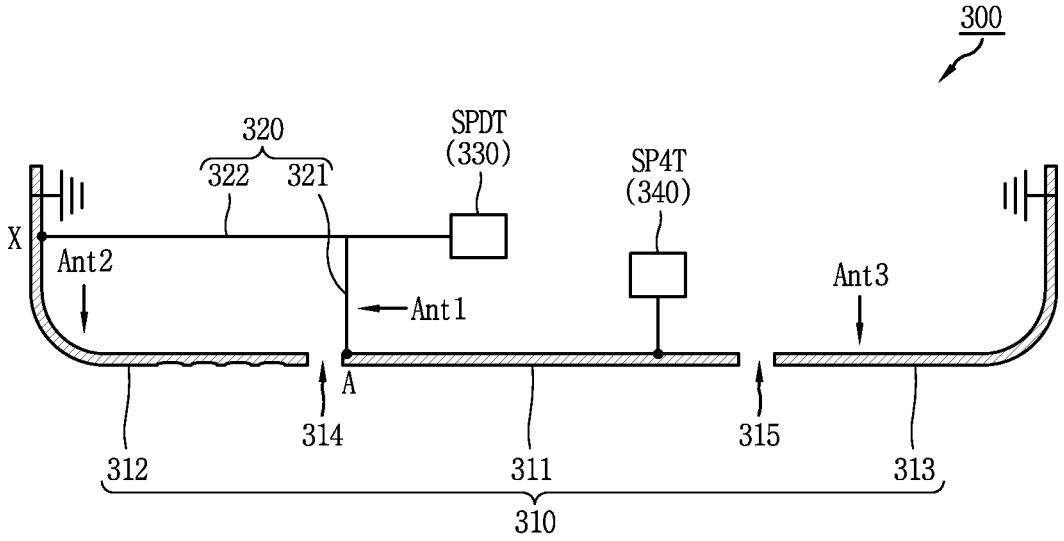
FIG. 3 is a view illustrating a wideband antenna using a metal frame and a metal pattern inside the mobile terminal according to the present invention.

Referring to FIG. 3, the antenna device 300 may be provided at an upper or lower end of the mobile terminal. In addition, the antenna device 300 may be provided in plurality disposed at each end portion of the terminal. Each antenna device may be configured to transmit and receive radio signals of different frequency bands. Each antenna device 300 includes conductive members 311 to 313 constituting a part of an outer metal frame 310. In this regard, at least some of the conductive members 311 to 313 may be electrically separated and may be referred to as first to third conductive members 311 to 313 for convenience. The first conductive member 311 forms a part of a lower end of the outer metal frame 310 of the mobile terminal. The second conductive member 312 is spaced apart from the first conductive member 311 to form parts of the lower end and a side surface of the outer metal frame 310. At this time, a speaker hole (SPK hole) may be provided on a part of the second conductive member 312.

On the other hand, an electrical length of the antenna may extend by using a metal pattern inside the mobile terminal. In this regard, referring to FIGS. 2 and 3, the antenna device of the mobile terminal will be described as follows. The antenna device 300 may include a conductive line 320 formed on one surface of the carrier 135. The conductive line 320 is connected to one point A of the first conductive member 311 and one point B of the second conductive member 312, respectively. In addition, the conductive line 320 are interconnected at one point A inside the mobile terminal. On the other hand, the second conductive member 312 operates as a second antenna Ant2 in a first frequency band different from a low-frequency band LB. That is, the antenna device 300 operates as the second antenna Ant2 in the first frequency band, which is a high frequency band (HB), due to a length of the second conductive member 312, independent of the first conductive member 311 and the conductive line 320.

Meanwhile, the first and second conductive members may be located on the outer metal frame 310 of the mobile terminal. The conductive line 320 may also be formed as a conductive pattern which is printed on one surface of the carrier 135 disposed in a space between the metal frame 201, 310 and the battery cover 203.

At this time, the conductive line 320 may be provided with one or more conductive lines 321, 322 which are electrically connected to each other such that the antenna can have an electric length for resonance in a specific frequency band. For example, the conductive line may be provided with a first conductive line 321 connected to one point of the first conductive member 311 and a second conductive line 322 connected to one point of the second conductive member 312. In this instance, the first and second conductive lines 321 and 322 may be connected to each other so as to be connected to an input of a Single Pole Double Through (SPDT) switch 330.

The third conductive member 313 may also be spaced apart from the first conductive member 311 to form parts of the lower end and a second side surface of the outer metal frame 310. At this time, similar to the second antenna Ant2, the third conductive member 313 may be connected to the ground at one point of the second side surface. On the other hand, the third conductive member 313 may operate as a third antenna Ant3 in a second frequency band. At this time, the second frequency band may be a middle frequency band (MB). At this time, the first conductive member 311 may be connected to an input of a Single Pole Four Through (SP4T) switch 340 at a predetermined position from a slit spaced apart from the third conductive member 313.

Meanwhile, the first to third conductive members 311 to 313 may form a part of the outer metal frame 310. In this regard, the first and second conductive members 311 and 312 are electrically connected in the low frequency band LB through the conductive line inside the mobile terminal, but may be electrically separated from each other in other frequency bands. In this regard, the second conductive member 312 is spaced apart from the first conductive member 311 by a first slit 314. Also, the third conductive member is spaced apart from the second conductive member by a second slit 315. On the other hand, in order for the first to third conductive members 311 to 313 to maintain a mechanically rigid shape, each of the first and second slits 314 and 315 may be provided with a supporter made of a dielectric material.

Hereinafter, a principle that the first and second antennas Ant1 and Ant2 operate independently will be described in detail. As shown in FIG. 3, the second conductive member 312 may be connected adjacent to the ground at a predetermined position from one point X thereof. In this regard, the criterion of "adjacent" may be decided based on a level at which the second antenna Ant2 operates independent of the first conductive member 311 in the high frequency band HB. With regard to this, if an electrical length from the ground to the end of the conductive line 320 in the high frequency band HB is $\lambda/4$, the second antenna Ant2 is electrically open at the point A. That is, since it is electrically short-circuited at the ground point, the second antenna Ant2 becomes electrically open at the point A where the electrical length is $\lambda/4$. Therefore, the second antenna Ant2 operating in the high frequency band HB is electrically opened at the point A where it is connected to the first conductive member 311, and thus it operates as independent antennas from the first conductive member 311. At this time, as a distance between the ground point and the point X becomes longer, a part of the second conductive member 312 (that is, a conductor area from the ground point to the point X) operates as the first antenna Ant1. As a result, isolation characteristics between the first and second antennas Ant1 and Ant2 are deteriorated. Therefore, it is advantageous that the distance between the ground point and the point X is short. However, if the ground point and the point X are too close to each other, the ground with respect to the second antenna Ant2 may mainly be affected by the conductive line 320 rather than the second conductive member 312, which may lower safety of the ground.

As described above, the antenna performance (radiation efficiency) in the low frequency band can be improved as the electrical length of the antenna extends using not only the outer metal frame 310 but also the metal pattern inside the mobile terminal. However, the antenna performance in the high frequency band may be lowered due to the electrical length increased by the inner metal pattern. Therefore, it is important to improve the antenna performance in the low frequency band and prevent deterioration of the antenna performance in the high frequency band by using the inner metal pattern. For this purpose, it is the technical advantages of the present invention that the inner metal pattern operating as an antenna in the low frequency band does not operate as an antenna in the high frequency band.

As described above, the structure of the plurality of antennas according to the present invention may be referred to as a ring metal 2 slit antenna structure. Specifically, it is a structure in which three radiators are separated by two slit structures. Accordingly, three feed systems can be implemented at the lower end of the mobile terminal. On the other hand, by virtue of the side short structure of the outer metal frame, a physical volume of the low frequency band (LB) antenna can be expanded, thereby achieving improvement of antenna efficiency. In addition, a short (ground) is disposed adjacent to a conductive line connection point of the second antenna Ant2 to minimize interference between the first and second antennas Ant1 and Ant2 due to the change in position of the short (ground). Further, feeding positions of the first and second antennas Ant1 and Ant2 may be realized on different substrates (layers). In this regard, the first antenna Ant1 may be implemented as a direct feed type and the second antenna Ant2 may be implemented as a coupled feed type. The feeders implemented on these different substrates can improve isolation between the antennas and also improve antenna bandwidth characteristics through the coupled feed type. In addition, as described later, it is possible to maximize efficiency of each frequency band by changing a wide-area switch topology and the antenna type.

In this regard, an antenna operating in a low frequency band is referred to as a first antenna Ant1, and an antenna operating in a high frequency band is referred to as a second antenna Ant2. That is, the antenna device 300 operates as the first antenna Ant1 in the low frequency band (LB) due to the length of the first conductive member 311 and the conductive line 320. As described above, as the antenna is implemented using the inner conductive line, it is not necessary to excessively increase the electrical length of the first conductive member 311.

Figure 4:
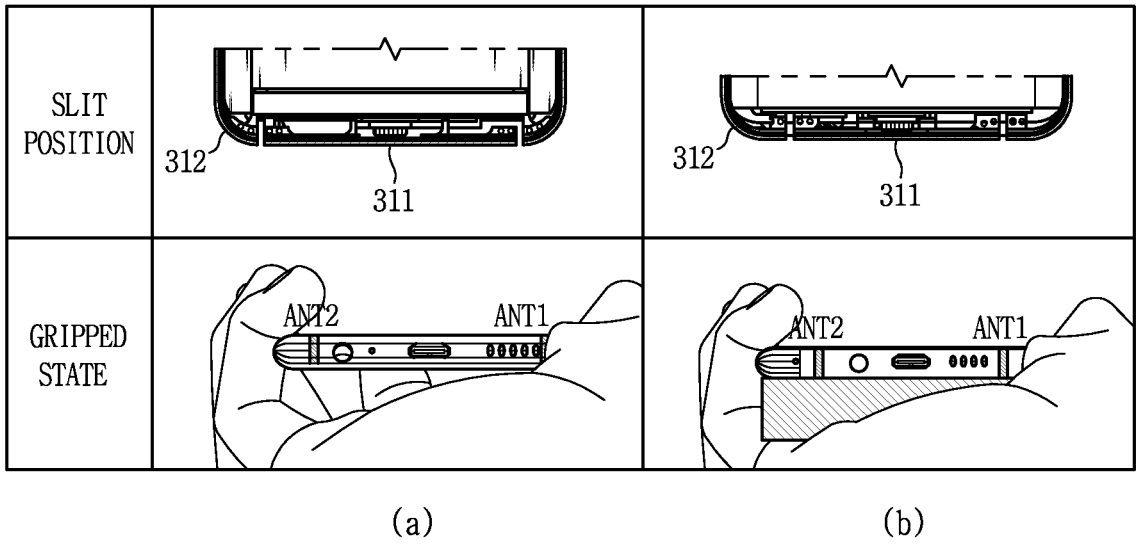
FIG. 4 is a view illustrating a relationship between an antenna and a hand effect according to the present invention.

In this regard, FIG. 4 is a view illustrating a relationship between an antenna and a hand effect according to the present invention. In other words, it is shown that the hand effect decreases as the length of the first conductive member 311 decreases. Referring to FIGS. 3 and 4, it can be seen that, as the length of the first conductive member 311 decreases, the influence on the antenna performance in the low frequency band is reduced even when the mobile terminal is gripped. For example, as shown in (a) of FIG. 4, when the first conductive member 311 is implemented without the ground (short) with the inner conductive line at an appropriate point, the electrical length may be 48.2 mm. As described above, as the electrical length of the first conductive member 311 increases, the hand effect increases when the mobile terminal is gripped. On the other hand, as shown in (b) of FIG. 4, if the first conductive member 311 is implemented by the ground (short) with the inner conductive line at an appropriate point, the electrical length may be reduced to 42.7 mm. Accordingly, as the electrical length of the first conductive member 311 decreases, the hand effect decreases when the mobile terminal is gripped.

On the other hand, as the second conductive member 312 operates as an antenna independently of the first conductive member 311 in the high frequency band, the electrical length of the second conductive member 312 increases compared to the conventional one. Thus, the second conductive member 312 occupies a large portion of the outer metal frame 310 in order to operate as an antenna. Therefore, even in the high-frequency band, a ratio of a gripped portion of the entire second conductive member 312 is reduced, and thus the deterioration of the antenna performance is also reduced. For example, as shown in (a), if the second conductive member 312 is implemented without the ground (short) with the inner conductive line at the appropriate point, the electrical length may be 10.05 mm. On the other hand, as shown in (b), if the second conductive member 312 is implemented by the ground (short) with the inner conductive line at the appropriate point, the electrical length may increase to 13 m. Accordingly, as the electrical length of the second conductive member 312 increases, the hand effect decreases when the mobile terminal is gripped.

Figure 5:
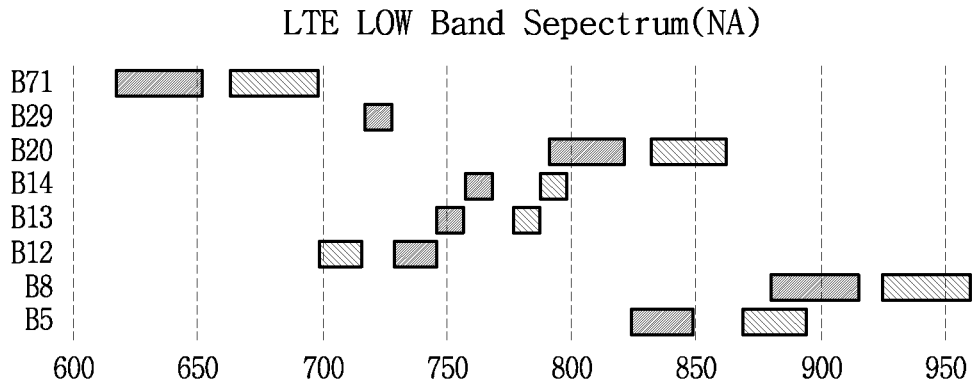
FIG. 5 is a view illustrating a frequency band spectrum of an LTE communication service provided by an antenna device according to the present invention.

Meanwhile, FIG. 5 shows a frequency band spectrum of an LTE communication service provided by the antenna device according to the present invention. Particularly, FIG. 5 shows a spectrum of a frequency band of 1 GHz or less in an LTE communication band. In the frequency band of 1 GHz or more in the LTE communication band, a bandwidth characteristic of an antenna is not much problematic from the perspective of a percentage bandwidth. On the other hand, in the frequency band of 1 GHz or less, the antenna must operate in a very wide frequency band from 600 MHz to 960 MHz. Therefore, in the related art, it is difficult to cover such a wide frequency band with only one antenna, and thus it is necessary to use a plurality of antennas or cover the performance of only one frequency band.

Particularly, there is a difficulty in guaranteeing the antenna performance in the low frequency band (LB). As such, the reason why it is difficult to secure a tuning range of about 200 MHz from 600 MHz to 800 MHz is that a physical space provided as an antenna space in a general mobile terminal can be used at about 800 MHz (B5, B8) and a bandwidth of 700 to 960 MHz cannot be satisfied only by a single antenna.

On the other hand, when carrying out carrier aggregation for receiving different signals (information) through two different carriers, the present invention can simultaneously receive different signals (information) through antennas of different regions. In this regard, the following will be described referring to FIGS. 1 to 5. First, the controller 180 may receive a first signal of the low frequency band LB through the first antenna Ant1 and simultaneously receive a second signal of the first frequency (HB) band. At this time, if a signal-to-interference ratio (SIR) of the second signal is a threshold value or less, the controller 180 may control the terminal to be operated into a mode of receiving only the first signal through the first antenna Ant1. In this regard, the controller 180 may request the base station (another terminal) to transmit only the first signal from the base station (the another terminal) when the SIR of the second signal is the threshold value or less.

As another embodiment, referring to FIG. 4, the controller 180 may perform the following operation when the user determines using a sensor (for example, a gyro sensor, a touch sensor, a SAR sensor, or the like) disposed in the terminal that the performance of the second antenna Ant2 is low. That is, when it is determined that the second antenna is gripped by the user, the controller 180 may switch the terminal into a mode of receiving only the first signal through the first antenna Ant1. In this regard, when it is determined that the second antenna is gripped by the user, the controller 180 may request the base station (another terminal) to transmit only the first signal from the base station (the another terminal). In this case where the first and second antennas operate independently while sharing a certain area, a mutual interference problem can be solved. That is, even when an SIR of a specific signal is reduced or a specific antenna area is gripped, the mutual interference problem can be solved when the first and second antennas operate independently while sharing the certain area.

In order to overcome the interference problem caused by a plurality of antenna areas as described above, the present invention proposes in one embodiment a method of appropriately dividing (separating) the outer metal frame and connecting the conductive line inside the mobile terminal and a specific position of the outer metal frame to the ground.

Particularly, the antenna device 300 proposed in the present invention can obtain desired antenna performances both in the low frequency band and the high frequency band only by one antenna, in a manner of appropriately dividing the outer metal frame 310 with a slit structure and appropriately using the inner metal pattern. On the other hand, even though the desired antenna performance can also be obtained by using two antennas, that is, the first and second antennas Ant1 and Ant2, the antenna device may further include a third antenna Ant3 which operates in a medium frequency band (MB) to more improve the antenna performance.

In this regard, the third conductive member 313 may be spaced apart from the first conductive member 311 to form parts of the lower end and a second side surface of the outer metal frame. Also, similar to the second antenna Ant2, the third conductive member 313 may be connected to the ground at one point of the second side surface. On the other hand, the third conductive member 313 may operate as a third antenna Ant3 in a second frequency band. At this time, the second frequency band may be a middle frequency band (MB).

On the other hand, it is possible to adjust a resonant frequency of the antenna and change an antenna type by using the aforementioned new type of wide range switch topology. In this regard, an SP4T switch may be used for tuning the resonant frequency of the antenna, and an SPDT switch may be used to change a physical volume of the antenna or an antenna type. In detail, the first and second conductive members 311 and 312 may operate as a monopole antenna or a loop antenna through a change in a position of an electric short and the operation of the SPDT switch. As such, wideband antenna characteristics can be implemented and efficiency for each frequency can be maximized through the change of the antenna type and the switch topology. Particularly, the expansion of the physical volume of the antenna in the low frequency band (LB) is allowed by use of a metal-ring shape and a side short structure, and thus the antenna performance can be improved. Further, the form that the first to third antennas share a partial structure results in ensuring a space for the second and third antennas as well as the first antenna.

Figure 6:
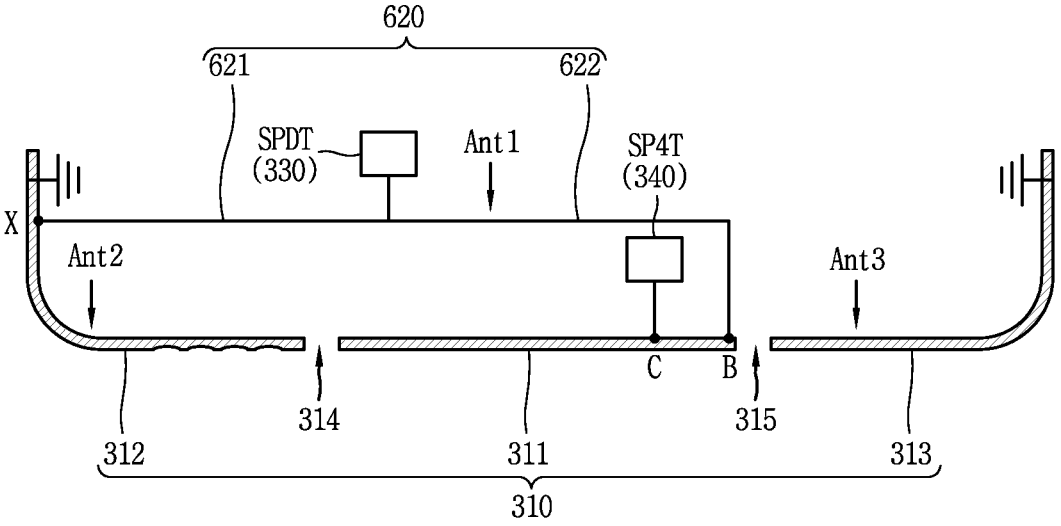
FIG. 6 is a view illustrating a conductive line inside a mobile terminal in accordance with another embodiment of the present invention.

Meanwhile, with regard to the shape of the conductive line, the conductive line may be connected to one end portion of the first conductive member 311 as shown in FIG. 3, or to another end portion of the first conductive member 311 as shown in FIG. 6. That is, FIG. 6 illustrates a shape of a conductive line inside a mobile terminal according to another embodiment of the present invention. As shown in FIG. 6, a conductive line 620 has a shape in which an electric length thereof is increased as compared to the conductive line 320 in FIG. 3. Referring to FIG. 3, the conductive line 320 is provided with the first conductive line 321 connected to the one point of the first conductive member 311, and the second conductive line 322 connected to the first point of the second conductive member 320. At this time, the first conductive line 321 may be connected to the first conductive member 311 through the first point A adjacent to the first slit 314.

On the other hand, referring to FIG. 6, the conductive line 620 is provided with a first conductive line 621 connected to one point of the first conductive member 311, and a second conductive line 622 connected to a first point of the second conductive member 312. At this time, the second conductive line 622 may be connected to the first conductive member 311 through a second point B adjacent to a second slit 315. Hereinafter, description will be given of the first point A at which the conductive line 310, 320 is connected and the second point B at which the conductive line 310, 620 is connected. First, referring to FIG. 3, the first point A may be located at the left side of a connection point of the SP4T switch on the first conductive member 311. On the other hand, referring to FIG. 6, it may be connected to the SP4T switch at a third point C of the first conductive member 311. At this time, the second point B may be located at a right side of the third point C on the first conductive member 311. That is, the second point B may be located on the first conductive member 311 between the third point C and the second slit 315.

On the other hand, the electrical length of the conductive line 620 (or from the adjacent ground to the conductive line 620) may be λ/4 in the first frequency band. Accordingly, the first and second antennas can operate independently. The electrical length of the conductive line 620 and the first conductive member 311 (or from the adjacent ground to the conductive line 620 and the first conductive member 311) is λ/4 in the low frequency band (LB). That is, the first antenna can resonate in a lower low frequency band LB by virtue of the conductive line 620 having the increased length as shown in FIG. 6.

Figure 7A:
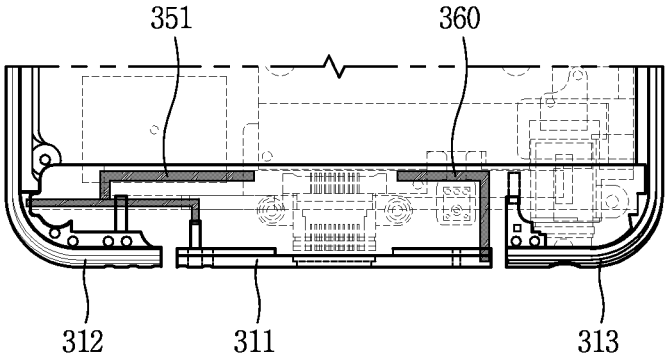
FIGS. 7A to 7C are views illustrating a feeding structure and a tuning form of first to third antennas according to the present invention.
Figure 7B:
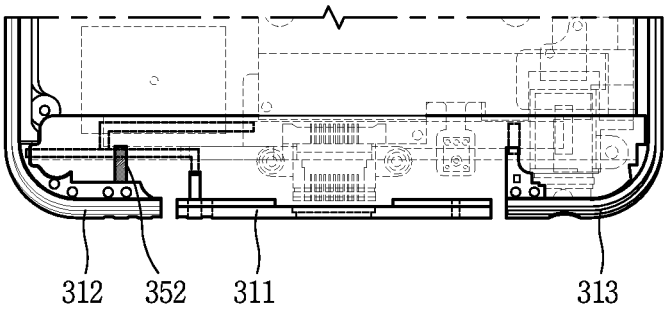
Figure 7C:
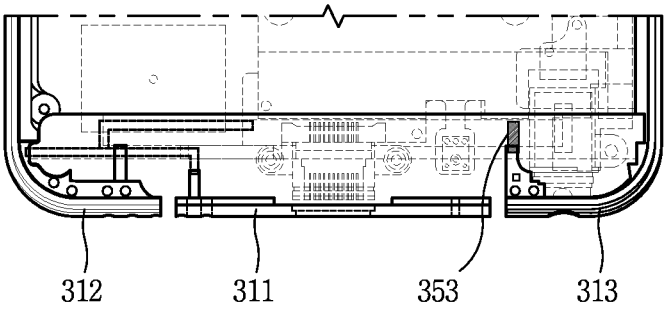

Hereinafter, a structure of feeding the first to third antennas and tuning them in a specific frequency band will be described in detail. In this regard, FIGS. 7A to 7C show a feeding structure and a tuning form of the first to third antennas according to the present invention. Specifically, FIG. 7A shows a first antenna, a feeding structure, and a tuning form according to the present invention. As illustrating in FIGS. 3 and 7A, the first antenna Ant1 includes first and second conductive members 311 and 312, a conductive line 320, and a first feeding part 351. The first feed part 351 is connected to the first conductive line 311 at the second point B located between the ground on the first conductive member 311 and the connected point of the first and second conductive lines 321 and 322. In this instance, the first feeding part 351 may be configured to feed the first antenna operating in the low frequency band (LB) by the length of the first conductive member 311 and the conductive line 320. The first antenna Ant1 may further include a stub part 360 that is electrically connected on the first conductive member 311 and is configured to tune resonance characteristics of the first antenna Ant1 such that the first antenna Ant1 operates in the low frequency band (LB). On the other hand, the first antenna Ant1 may operate not only in the low frequency band but also in some of the middle frequency band (MB).

On the other hand, FIG. 7B shows the second antenna and a feeding structure according to the present invention. As shown in FIG. 7B, the second antenna Ant2 includes a second conductive member 312 and a second feeding part 352. The second feeding part 352 is connected to the second conductive member 312 on one end portion of the first conductive member 311. The second feed part 352 is electrically connected on the second conductive member 312. The second feeding part 352 feeds the second antenna Ant2 operating in the first frequency band by the length of the second conductive member 312.

On the other hand, FIG. 7C shows the third antenna and a feeding structure according to the present invention. As shown in FIG. 7C, the third antenna Ant2 includes a third conductive member 313 and a third feeding part 353. The third feeding part 353 is electrically connected on the third conductive member 313. Further, the third feeding part 353 feeds the third antenna Ant3 operating in the second frequency band by the length of the third conductive member 313.

For example, a carrier 135, on which the conductive member is formed, may be coupled to the case 201 by a coupling member such as a screw. At this time, the screw may be coupled to a hole 262 formed on the case 201 through a through hole formed at the carrier 135. Ribs 263 of the frame 260, which will be described later, may limit a space in which the carrier 135 is mounted.

The first to third feeding parts 351 to 353 in FIGS. 7A to 7C perform impedance matching of the first to third antennas and operate as additional radiators for extending bandwidth characteristics. Meanwhile, the stub part 360 controls the resonant frequency for the wideband operation in the low frequency band (LB) and adjusts the antenna performance. The stub part 360 may appropriately adjust a length of a stub so that an isolation characteristic between antennas (specifically, the first and second antennas Ant1 and Ant2) can be a specific level or less. Accordingly, the antennas (particularly, the first and second antennas Ant1 and Ant2) can be regarded as operating independently in different frequency bands.

Figure 8A:
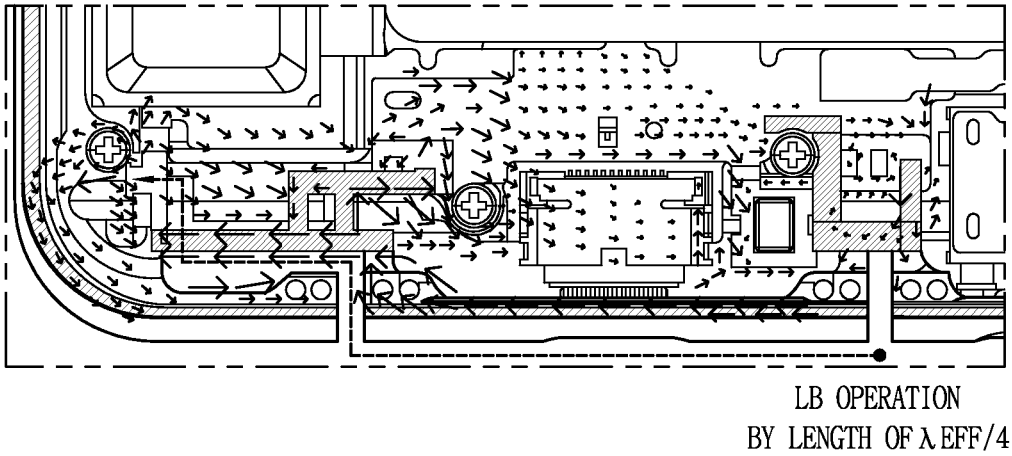
FIGS. 8A and 8B are views illustrating current distributions of first and second antennas operating in different frequency bands according to the present invention.
Figure 8A:
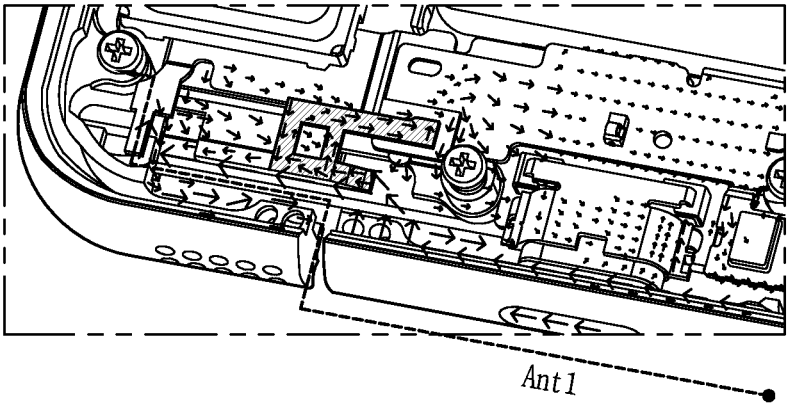
Figure 8B:
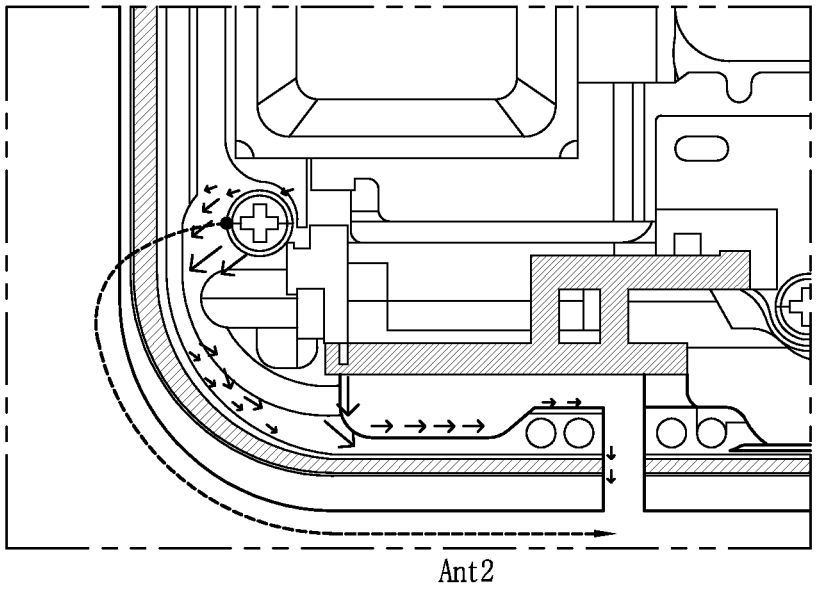

FIGS. 8A and 8B show current distributions of first and second antennas operating in different frequency bands according to the present invention. Specifically, FIG. 8A shows a current distribution of the first antenna operating in the low frequency band (LB) according to the present invention. As shown in FIG. 8A, it can be seen that the first antenna Ant1 generates a current on the first conductive member and the inner conductive line. That is, it can be seen that a current level toward the second antenna Ant2 is considerably lower than a current level of the first antenna Ant1. In other words, it can be seen that a current distribution toward an area of the first antenna Ant 1 is dominant and a less amount of currents flows toward an area of the second antenna Ant2 in the low frequency band LB to thus rarely affect the area of the second antenna Ant2. Accordingly, the first antenna Ant1 resonates by the electrical length corresponding to the length of the first conductive member and the conductive line. For example, the first antenna Ant1 may operate in the low frequency band LB by the electrical length of the first conductive member and the internal conductive line (λ/4).

On the other hand, FIG. 8B shows a current distribution of the second antenna operating in the first frequency band higher than the low frequency band (LB) according to the present invention. As shown in FIG. 8A, it can be seen that a current of the second antenna Ant2 is generated on the second conductive member. Thus, the second antenna Ant2 resonates by the electrical length corresponding to the length of the second conductive member.

Hereinafter, a current distribution characteristic according to whether or not a side short is applied to the outer metal frame and a position of the side short, and operations of the antennas according to the characteristics will be described.

Figure 9A:
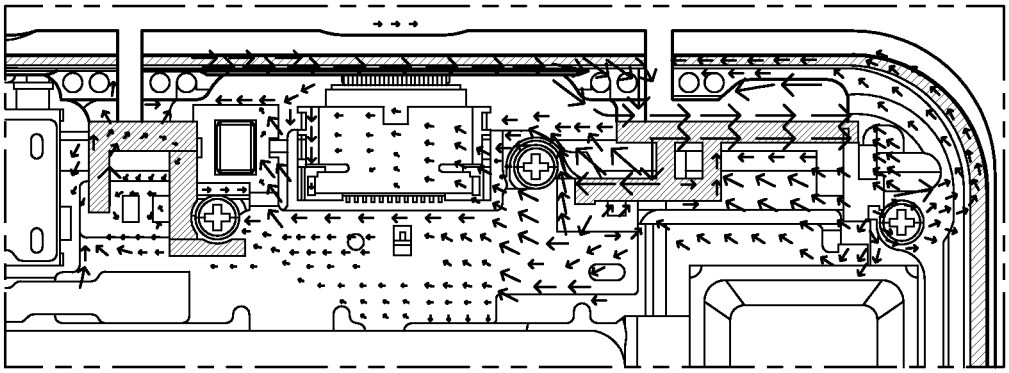
FIGS. 9A and 9B are views illustrating current distributions when a side short is applied to an outer metal frame and when the side short is not applied to the outer metal frame.
Figure 9B:
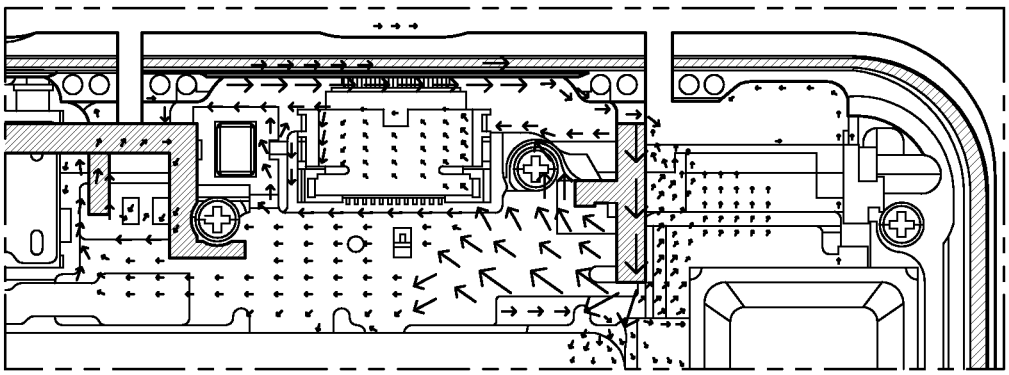
Figure 9C:
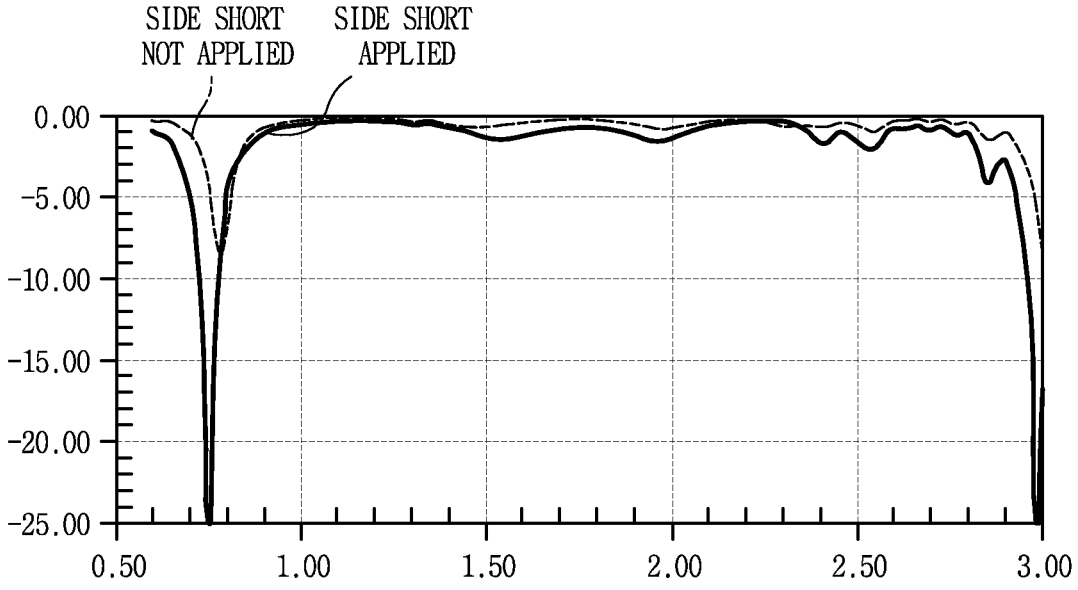
FIG. 9C is a view illustrating reflection loss characteristic depending on whether a side short is applied to an outer metal frame according to one embodiment of the present invention.

In this regard, FIGS. 9A and 9B show a current distribution when the side short is applied to the outer metal frame and a current distribution when the side short is not applied to the outer metal frame. At this time, it is assumed that the conductive line is positioned on the carrier to reduce interference with the display and the metal frame. As shown in FIG. 9A, when the side short is applied to the outer metal frame, the current is distributed through the entire inner conductive line, so that the electrical length of the first antenna Ant1 can be secured in the low frequency band (LB). On the other hand, as illustrated in FIG. 9B, when the side short is not applied to the outer metal frame, the current is distributed only in a partial area of the inner conductive line. Accordingly, it is impossible to secure the electrical length of the first antenna Ant1 in the low frequency band (LB). That is, since a current path is shortened in the low frequency band (LB), the resonant frequency increases and the antenna performance is also lowered. In this regard, FIG. 9C shows reflection loss characteristic depending on whether or not the side short is applied to the outer metal frame according to one embodiment of the present invention. If the side short is not applied to the outer metal frame, the resonant frequency increases as described above, which makes it difficult to cover the low frequency band (LB) and increase a reflection loss level, thereby lowering the antenna performance.

Figure 10A:
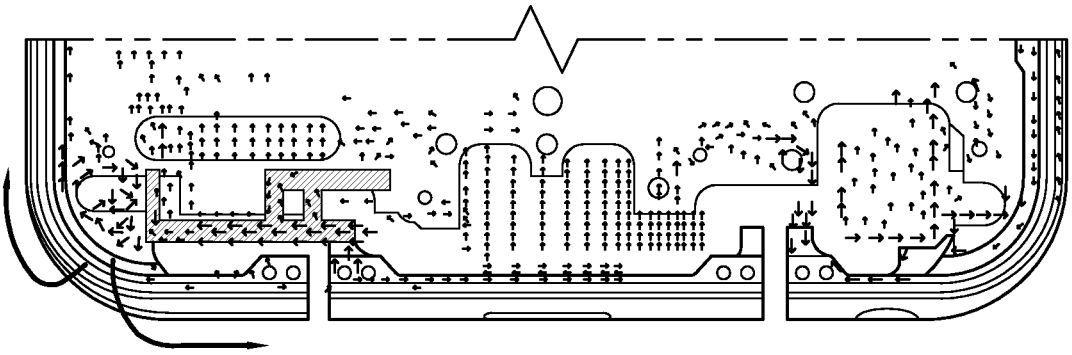
FIGS. 10A and 10B are views illustrating current distributions according to a change in a position of a short pin of a side short applied to an outer metal frame.
Figure 10B:
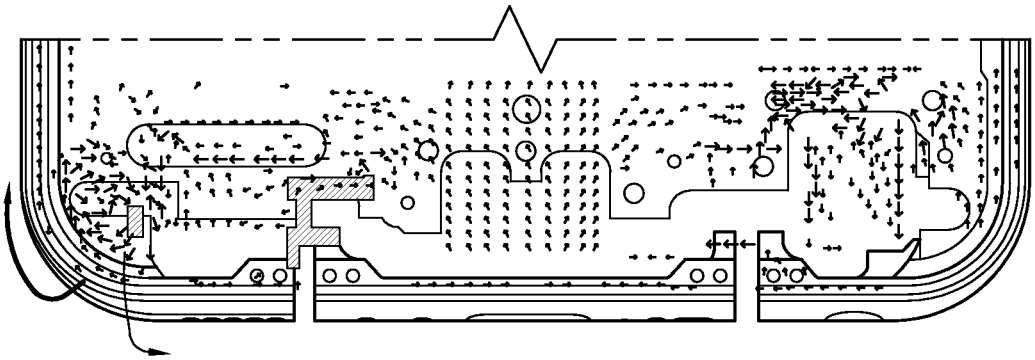

FIGS. 10A and 10B are views illustrating current distributions according to a change in a position of a short pin of the side short applied to the outer metal frame. As shown in FIG. 10A, a high frequency band (HB) resonance mode is generated with respect to the second antenna Ant2 in the first frequency band (high frequency band) when located on a side surface of the second conductive member. Therefore, the second antenna Ant2 operates as a radiator in the first frequency band (high frequency band). This is because the electrical length of the second antenna Ant2, that is, the physical length from a short pin position to the end of the second antenna Ant2 satisfies the resonance length.

On the other hand, as shown in FIG. 10B, it can be seen that the high frequency band (HB) resonance mode is not generated with respect to the second antenna Ant2 in the first frequency band (high frequency band) when it is located at another position on the second conductive member (e.g., at the lower end (i.e., an open position of the second antenna Ant2)). Therefore, the second antenna Ant2 does not operate as a radiator in the first frequency band (high frequency band). This is because the electrical length of the second antenna Ant2, that is, the physical length from the short pin position to the end of the second antenna Ant2 does not satisfy the resonance length.

The foregoing description has been given of the wideband antenna device using the outer metal frame and the inner conductive line and the mobile terminal having the same according to the present invention. As such, the plurality of antenna structures according to the present invention can be referred to as a ring metal 2 slit antenna structure. Specifically, it is a structure in which three radiators are separated by two slit structures. Accordingly, three feed systems can be implemented at the lower end of the mobile terminal. On the other hand, by virtue of the side short structure of the outer metal frame, the physical volume of the low frequency band (LB) antenna can be expanded, thereby achieving improvement of antenna efficiency. In addition, a short (ground) is disposed adjacent to a conductive line connection point of the second antenna Ant2 to minimize interference between the first and second antennas Ant1 and Ant2 due to the change in position of the short (ground). Further, feeding positions of the first and second antennas Ant1 and Ant2 may be realized on different substrates (layers). In this regard, the first antenna Ant1 may be implemented as a direct feed type and the second antenna Ant2 may be implemented as a coupled feed type. The feeders implemented on these different substrates can improve isolation between the antennas and also improve antenna band bandwidth characteristics through the coupled feed type. In addition, as described later, it is possible to maximize efficiency of each frequency band by changing a wide-area switch topology and the antenna type.

Hereinafter, technical effects of a mobile terminal and an antenna device according to the present invention will be described.

According to at least one of embodiments of the present invention, an antenna device which is capable of fully covering a low frequency band including an LTE and has a hand-effect compensation function, and a mobile terminal can be provided.

Further, according to at least one of embodiments of the present invention, deterioration of antenna characteristics due to a contact with a user's body can automatically be recognized, thereby improving the deterioration of the antenna characteristics.

Furthermore, according to at least one of embodiments of the present invention, an antenna device that operates even in a situation simultaneously using a plurality of frequency bands can be provided.

Further scope of applicability of the present invention will become apparent from the following detailed description. It should be understood, however, that the detailed description and specific examples, such as the preferred embodiment of the invention, are given by way of illustration only, since various changes and modifications within the spirit and scope of the invention will be apparent to those skilled in the art.

In relation to the present invention, design and operations of an antenna device can be implemented as computer-readable codes in a program-recorded medium. The computer-readable medium may include all types of recording devices each storing data readable by a computer system. Examples of such computer-readable media may include hard disk drive (HDD), solid state disk (SSD), silicon disk drive (SDD), ROM, RAM, CD-ROM, magnetic tape, floppy disk, optical data storage element and the like. Also, the computer-readable medium may also be implemented as a format of carrier wave (e.g., transmission via an Internet). The computer may include the controller 180 of the terminal. Therefore, it should also be understood that the above-described embodiments are not limited by any of the details of the foregoing description, unless otherwise specified, but rather should be construed broadly within its scope as defined in the appended claims, Therefore, all changes and modifications that fall within the metes and bounds of the claims, or equivalents of such metes and bounds are therefore intended to be embraced by the appended claims.

What is claimed is:

1. A terminal, comprising:

a first conductive member forming a part of a lower end of an outer metal frame of the terminal and configured to operate as a first antenna;

a second conductive member spaced apart from the first conductive member to form a part of the lower end and a part of a first side surface of the outer metal frame and configured to operate as a second antenna;

a third conductive member spaced apart from the first conductive member and forming a part of the lower end and a part of a second side surface of the outer metal frame; and a controller configured to receive a first signal of a low frequency band through the first antenna and simultaneously receive a second signal of a first frequency band, wherein the second conductive member is spaced apart from the first conductive member by a first slit, wherein the first conductive member is spaced apart from the third conductive member by a second slit, and wherein the controller receives only the first signal through the first antenna when a signal-to-interference ratio (SIR) of the second signal is less than or equal to a threshold value.

2. The terminal of claim 1, further comprising a conductive line connected to a first point of the first conductive member and a second point of the second conductive member, and wherein the second conductive member is configured to operate as the second antenna in the first frequency band different from the low frequency band.

3. The terminal of claim 2, further comprising a frame which comprises the outer metal frame, wherein the conductive line is formed as a conductive pattern printed on a carrier disposed between the frame and a battery cover.

4. The terminal of claim 2, wherein the conductive line comprises a first conductive line connected to the first point of the first conductive member and a second conductive line connected to the second point of the second conductive member, and the first and second conductive lines are connected to each other so as to be connected to an input of a single pole double through (SPDT) switch.

5. The terminal of claim 4, further comprising a first feeding part connected to the first conductive line at a first feeding point located between a ground on the first conductive member and a connection point of the first and second conductive lines, wherein the first feeding part is configured to feed the first antenna operating in the low frequency band based on a length of the first conductive member and the conductive line.

6. The terminal of claim 5, further comprising a stub part electrically connected to the first conductive member and configured to tune a resonance characteristic of the first antenna so that the first antenna operates in the low frequency band.

7. The terminal of claim 5, further comprising a second feeding part connected to the second conductive member on one end portion of the first conducting member, wherein the second feeding part is electrically connected to the second conductive member and feeds the second antenna operating in the first frequency band based on a length of the second conductive member.

8. The terminal of claim 2, wherein the conductive line comprises a first conductive line connected to the first point of the first conductive member and a second conductive line connected to the second point of the second conductive member, and wherein the second conductive line is connected to the first conductive member via the first point adjacent to the first slit.

9. The terminal of claim 8, wherein the first conductive member and an input of the SP4T switch are connected at a fourth point on the first conductive member, and wherein the first point is formed on the first conductive member between the first slit and the fourth point.

10. The terminal of claim 8, wherein the first conductive member and an input of the SP4T switch are connected at a fourth point on the first conductive member, and wherein the first point is located on the first conductive member between the fourth point and the second slit.

11. The terminal of claim 2, wherein the conductive line comprises a first conductive line connected to the first point of the first conductive member and a second conductive line connected to the second point of the second conductive member, and wherein the second conductive line is connected to the first conductive member via the first point adjacent to the second slit.

12. The terminal of claim 1, wherein the third conductive member is connected to a ground at a third point of the second side surface, and wherein the third conductive member is configured to operate as a third antenna in a second frequency band.

13. The terminal of claim 12, further comprising a third feeding part connected to the third conductive member at one end portion of the third conductive member, wherein the third feeding part is electrically connected to the third conductive member and is configured to feed the third antenna operating in the second frequency band based on a length of the third conductive member.

14. The terminal of claim 1, wherein the first conductive member is connected to an input of a single pole four through (SP4T) switch at a fourth point of the first conductive member spaced apart from a slit between the first conductive member and the third conductive member.

15. A terminal, comprising:

a first conductive member forming a part of a lower end of an outer metal frame of the terminal and configured to operate as a first antenna;

a second conductive member spaced apart from the first conductive member to form a part of the lower end and a part of a first side surface of the outer metal frame and configured to operate as a second antenna;

a third conductive member spaced apart from the first conductive member and forming a part of the lower end and a part of a second side surface of the outer metal frame; and a controller configured to receive a first signal of a low frequency band through the first antenna and simultaneously receive a second signal of a first frequency band, wherein the second conductive member is spaced apart from the first conductive member by a first slit, wherein the first conductive member is spaced apart from the third conductive member by a second slit, and wherein the controller receives only the first signal through the first antenna when it is determined that the second antenna is gripped by a user.

16. The terminal of claim 15, further comprising a conductive line connected to a first point of the first conductive member and a second point of the second conductive member, and wherein the second conductive member is configured to operate as the second antenna in the first frequency band different from the low frequency band.

17. The terminal of claim 16, wherein the conductive line comprises a first conductive line connected to the first point of the first conductive member and a second conductive line connected to the second point of the second conductive member.

18. The terminal of claim 17, further comprising a first feeding part connected to the first conductive line at a first feeding point located between a ground on the first conductive member and a connection point of the first and second conductive lines, wherein the first feeding part is configured to feed the first antenna operating in the low frequency band based on a length of the first conductive member and the conductive line.

19. The terminal of claim 17, further comprising a second feeding part connected to the second conductive member, wherein the second feeding part is electrically connected to the second conductive member and feeds the second antenna operating in the first frequency band based on a length of the second conductive member.

20. The terminal of claim 15, wherein the third conductive member is configured to operate as a third antenna in a second frequency band.

* * * * *